US009278830B1

(12) United States Patent
Conrad

(10) Patent No.: US 9,278,830 B1
(45) Date of Patent: Mar. 8, 2016

(54) HEAVY LOAD SLING PROTECTIVE PAD

(71) Applicant: The Rigging Box, Inc., Lorton, VA (US)

(72) Inventor: Selina Conrad, Lorton, VA (US)

(73) Assignee: The Rigging Box, Inc., Lorton, VA (US)

( * ) Notice: Subject to any disclaimer, the term of this patent is extended or adjusted under 35 U.S.C. 154(b) by 0 days.

(21) Appl. No.: 14/497,526

(22) Filed: Sep. 26, 2014

(51) Int. Cl.
*B66C 1/12* (2006.01)

(52) U.S. Cl.
CPC ..... *B66C 1/122* (2013.01)

(58) Field of Classification Search
USPC ..... 294/74, 65.5; 410/41, 99; 206/453, 486
See application file for complete search history.

(56) References Cited

U.S. PATENT DOCUMENTS 4,039,218 A * 8/1977 Bryant ..... B66C 1/122 294/74
4,441,748 A * 4/1984 St. Germain ..... B66C 1/122 294/74
4,877,673 A * 10/1989 Eckel ..... B65D 81/054 206/453
4,938,357 A * 7/1990 Schmidt ..... B65D 71/04 206/453
5,188,407 A * 2/1993 Villaveces ..... B60R 13/04 280/770
5,385,236 A * 1/1995 Cowan ..... B65D 71/04 206/453
5,848,865 A * 12/1998 Beals ..... B60P 7/0869 410/41
5,943,963 A * 8/1999 Beals ..... B61D 45/001 105/355
6,123,479 A * 9/2000 Dumke ..... B45F 15/00 211/46
7,311,483 B1 * 12/2007 Nudo ..... B60P 7/0869 410/41
7,744,138 B2 * 6/2010 St. Germain ..... B66C 1/122 294/74
8,123,268 B1 2/2012 Conrad
8,672,375 B2 3/2014 Conrad
2009/0044888 A1 * 2/2009 Ganey ..... A47H 21/00 150/154
2009/0058148 A1 * 3/2009 Garrity ..... B60P 3/40 296/216.09

* cited by examiner

*Primary Examiner* — Paul T Chin
(74) *Attorney, Agent, or Firm* — Whitham, Curtis, Christoffesson & Cook, P.C.

(57) ABSTRACT

A heavy load protective pad for use on industrial slings includes fasteners on a sleeve forming member which are secured together to encircle and secure the protective pad on an industrial sling at a desired location. Pockets formed in the protective pad house a pair of magnets which help the pad stay in place while attached to metal surfaces and a pair of block spacers which, in one configuration, serve to space the protective pad and underlying sling away from the load which is being lifted or pulled.

19 Claims, 4 Drawing Sheets

HEAVY LOAD SLING PROTECTIVE PAD

FIELD OF THE INVENTION

The invention is related to pad devices for industrial slings that are designed to lift or pull heavy loads (e.g., machinery, structural members, concrete objects, etc.), and more particularly to protective pad devices containing magnets which allow the protective pads to adhere to metal objects. In particular embodiments, the pads protect such slings from the edges or corners of these loads (e.g., shipping container edges, etc.) and minimize the movement of such slings in relation to the load.

BACKGROUND OF THE INVENTION

Industrial slings are used to lift and move heavy objects. They are used at shipping yards, construction sites, loading areas, and in a wide variety of other applications. Industrial slings have been made from chains and wire cables in the past; however, many of today's slings (e.g., those employed in the last two decades) are made of tough and durable fibers, and they resemble a strap which is wrapped around the load for lifting and/or pulling operations. These fiber slings can be subject to catastrophic failure if they are cut, subjected to abrasion, or are otherwise worn down. This type of damage can occur when the object being lifted or pulled has a sharp corner or edge, and the sling is held taught against the edge during the lifting or pulling operation.

As discussed in U.S. Pat. No. 7,744,138 to St. Germain, which is herein incorporated by reference, there are a number of ways the problem of sling degradation and failure can be addressed. For example, the object to be lifted (e.g., a pipe section, a cargo container, structural steel, etc.) can be fabricated with eye bolts or hooks, and the sling would be slipped through the eye bolts or hooks for lifting operations. After moving the object, the eye bolts or hooks could be removed. Another example is to manufacture protectors from angular pieces of cardboard that abut against edges of the objects to be moved (e.g., U.S. Pat. No. 6,470,637 to Gratz describes molded pulp corner protector to protect windows during shipment).

U.S. Pat. No. 7,744,138 to St. Germain, as well as the Cornermax™ sold by Slingmax for many years prior to the filing of the St. Germain patent, describe corner pads used with industrial slings. These pads form a tunnel between load edge and the pad so that the pad as well as the underlying sling are protected from contacting the load edge during lifting or pulling. However, these corner pads are somewhat cumbersome as they require two pairs of mating straps to be looped around the sling and joined together by Velcro® (hook and loop connector).

U.S. Pat. Nos. 8,123,268 and 8,672,375 to Conrad, which are herein incorporated by reference, describe wearpads which protect industrial slings from the edges or corners of loads.

SUMMARY OF THE INVENTION

An object of the invention is to provide more stable corner protectors for use on an industrial sling which allow the protectors to stay in place as loads are lifted or pulled using magnets to adhere to metal objects. Protective wearpads containing magnets are an improvement over that which is used and described in the prior art.

According to the invention, a heavy load industrial sling protective pad is constructed from a sleeve forming member.

The sleeve forming member is preferably a tough sleeve shaped material such as Cordura®, Kevlar®, or other fibrous material which can withstand abrasion, exposure to water and ultraviolet radiation, heat, etc. that may be encountered when using industrial slings. The addition of magnets to protective pads allows the pad to adhere to metal loads as they are lifted or pulled.

In alternative embodiments, in addition to using magnets, fasteners, such as strips of Velcro® (hook and loop connectors), are sewn to a surface (e.g., top or bottom or both) of the sleeve forming member on its first and second edges. The sleeve forming member can thus be attached to an industrial sling at any location required for protecting the industrial sling simply by placement at the desired location and fastening the fasteners together to encircle and secure the sleeve forming member to the industrial sling.

In a first embodiment, in one portion of the sleeve forming member (e.g., the top or bottom half, etc.) there are a pair of pockets which preferably hold block spacers and magnets. The pockets are created by stitching in the sleeve forming member. In a preferred embodiment, there is a central stitch line which divides the sleeve forming member generally in half, and a generally perpendicular stitch line which divides at least the top and/or bottom half into, e.g., quarters. The block spacers and magnets are inserted into these pockets and the pockets are sewn closed.

Preferably, the inside of the pockets are lined with a Kevlar® felt or other tough material which can withstand ripping and cutting. The block spacers, have height, depth and width dimensions. The height of the block spacers is such that a gap between the generally perpendicular stitch line between the pockets and a top edge of the block spacers is created when one of the block spacers is positioned on a load on one side of an edge and the other block spacer is positioned on the load on the other side of the edge. In some embodiments, the magnets may be flat type or button type and may be attached to the block spacers. In some embodiments, the block spacers are magnetized or have magnets embedded within the block spacer, thus negating the need for separate magnets.

In one configuration, this gap prevents the corner at the edge of the load from contacting the sleeve forming member or the underlying sling during heavy lifting and pulling operations. In this configuration, the sleeve forming member is secured to the sling by the fasteners such that the block spacers are interposed between the sling and the load which is being lifted or pulled. An alternative configuration of the heavy load protective pad allows the block spacers to be positioned on the sling spaced away from the load. In this configuration, the block spacers may be used to, for example, protect portions of the load from being crushed when the load is set down on a surface. The magnets allow for the protective pad to stay in place when attached to a metal surface. For example, when lifting or pulling a load containing a partial or full metal component, the magnet in the protective pad will be attracted to said metal and this attraction will prevent the pad from significantly changing its position in relation to the load during lifting or pulling.

In particular embodiments, magnets of the claimed invention are heavy duty magnets and have a pull force or strength of at least 25 pounds. The magnets of the claimed invention can be permanent magnets or electromagnets, preferably permanent magnets. If an electromagnet is used, a battery of some kind must accompany the electromagnet in order to provide an electric current.

A second embodiment is similar to the first embodiment except that the blocks are in a sideways orientation relative to the sleeve forming member. Like the first embodiment, the magnets and blocks are housed in side by side pockets having a center stitch therebetween, and the pockets can be lined with kevlar or other suitable mat material which resists ripping. The sleeve forming member can be made out of a tubular material or two sheets of material which can be sewn together. As discussed above, the sleeve forming member can be made of Cordura®, Kevlar®, or other fibrous material which can withstand abrasion, exposure to water and ultraviolet radiation, heat, etc. that may be encountered when using industrial slings. If the sleeve forming member is made of a tubular material, the ends are sewn closed. The ends of the sleeve forming member have fasteners such as strips of Velcro® (hook and loop connectors), are sewn to a surface (e.g., top or bottom or both) which are secured together to encircle the industrial sling at any desired location. In addition, like the first embodiment, the second embodiment can be used in either the first or second configuration on the industrial sling.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE INVENTION

Figure 1:
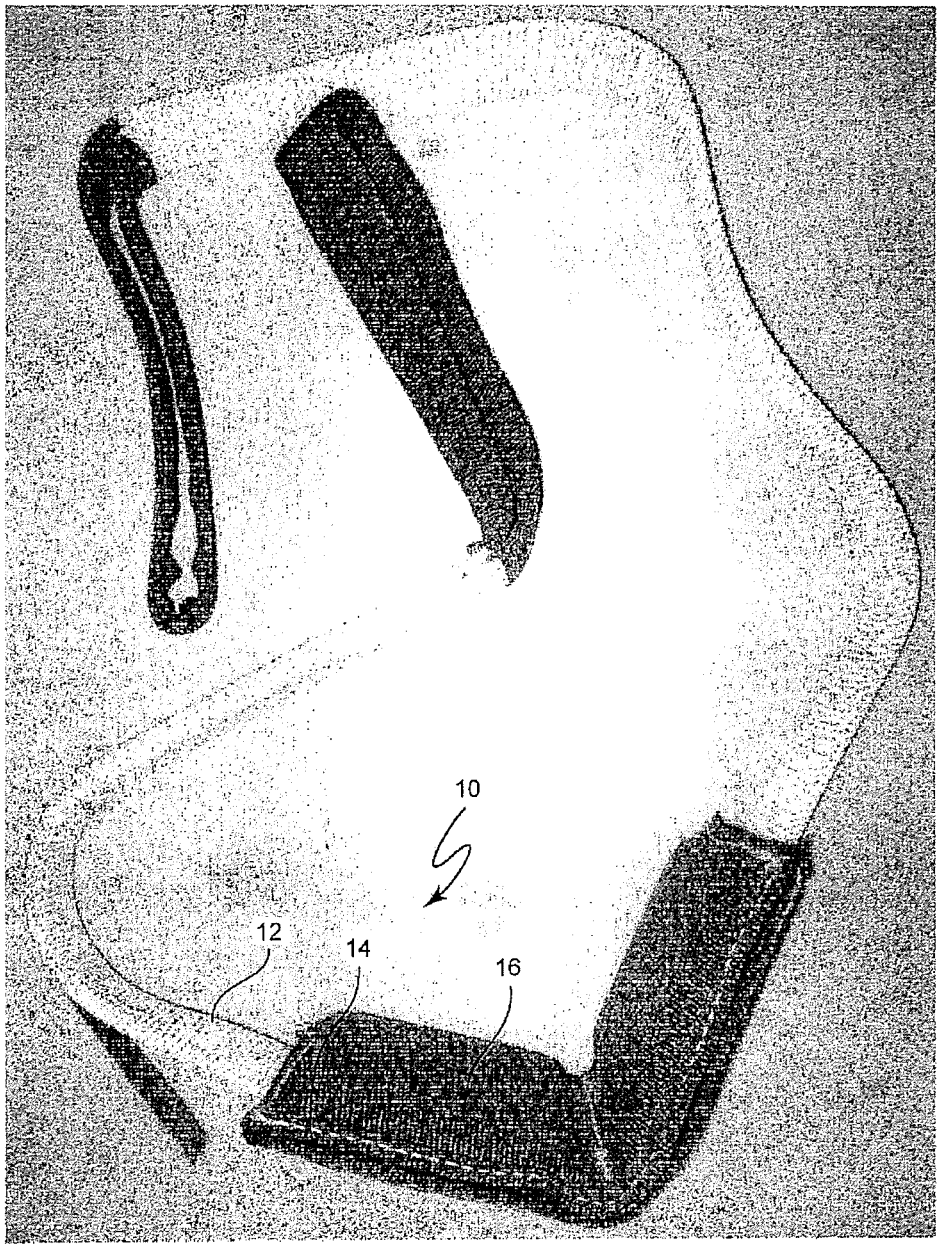
FIG. 1 is an isometric view of an exemplary heavy load protective pad secured to an industrial sling.

FIG. 1 shows an example of a heavy load protective pad 10 according to the present invention. The pad 10 is secured to an industrial sling 12 at any desired location simply by encircling the sling 10 and joining fasteners 14 at the top and bottom edges of a sleeve forming member 16.

Figure 2B:
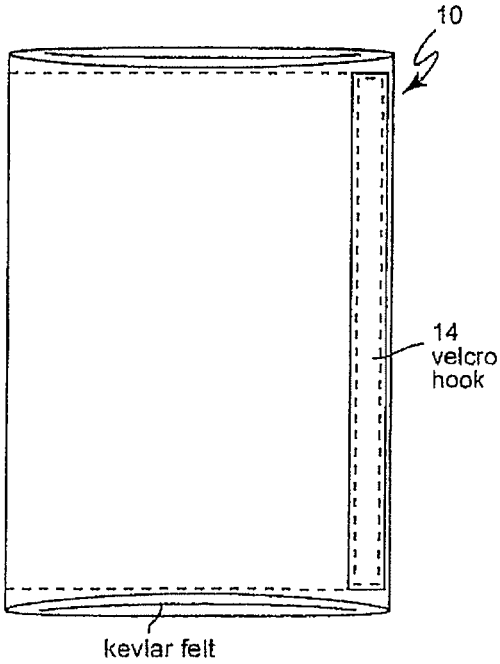
FIG. 2*b* is a plan view of the bottom half of the heavy load protective pad of FIG. 2 *a;*
Figure 2C:
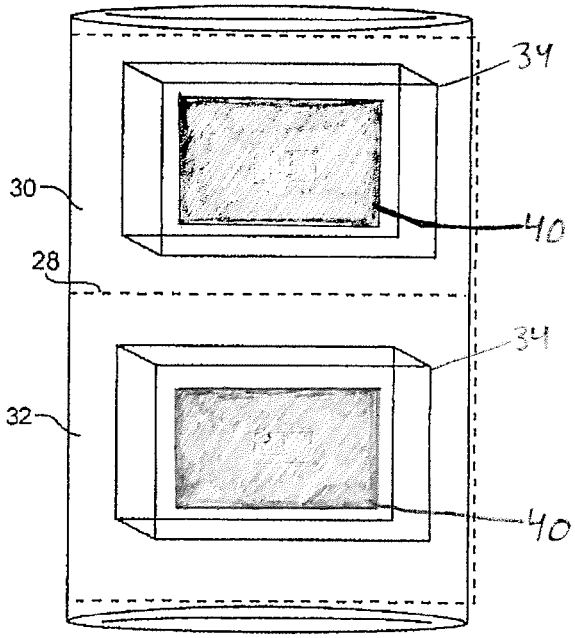
FIG. 2*c* is a cut-away plan view of the top half of the heavy load protective pad of FIG. 2 *a* showing block spacers within the pockets in the top half.
Figure 2A:
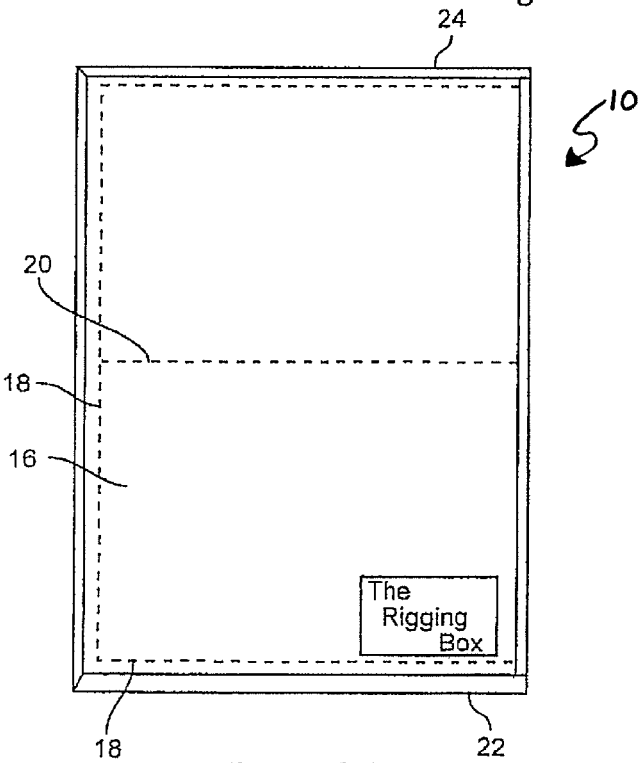
FIG. 2*a* is a plan view of an exemplary heavy load protective pad where the protective sleeve member is open.

With reference to FIG. 2*a*, it can be seen that the heavy load protective pad 10 is composed of a sleeve forming member 16. The sleeve forming member 16 is preferably a sleeve of material that is tough, durable, etc., such as a Cordura® or Kevlar® sleeve. Almost any material that is formed from fibers (synthetic or natural), which can withstand abrasion, cuts, water damage, and ultraviolet damage, or any other adverse condition in which industrial slings will be used could be used as the sleeve forming member 16. Further, while the sleeve forming member 16 is preferably itself a sleeve of material, in some applications the sleeve forming member 16 could be formed of two sheets of material that are joined together by stitching. FIG. 2*a* shows stitching 18 along the edges of the sleeve forming member, as well as central stitching 20 that essentially divides the sleeve forming member 16 into top and bottom halves. Velcro® (hook and loop) strips are preferably sewn on the underside of the sleeve forming member at the top 24 and bottom 22 edges. With reference back to FIG. 1, it can be seen that the Velcro® functions as a fastener 14 to secure the sleeve forming member 16 to the industrial sling at the desired location. Other fasteners, e.g., hooks, snaps, buttons, etc., might also be employed to secure the protective pad 10 to the industrial sling 12.

FIG. 2*b* shows the bottom half of the sleeve forming member 16 and illustrates the Velcro® secured to one edge of the sleeve forming member by stitch lines 14.

FIG. 2*c* shows a cut away view of the top half of the sleeve forming member 16. A stitch line 28 which is generally perpendicular to the central stitch line 20 shown in FIG. 2*b*, creates pockets 30 and 32 within the sleeve forming member 16. In some embodiments, inside each pocket 30 and 32 is placed a block spacer 34 and a magnet 40. A magnet of the claimed invention may be positioned in one pocket 30 or 32 or both pockets 30 and 32. The magnets can be the same or different and any type of magnet 40 may be used as long as the magnetic field strength and pull force of the magnet 40 is sufficient to attract said magnet 40 to the metal-containing load through the material of the pockets within the sleeve forming member. The magnets of the claimed invention can be permanent magnets or electromagnets, preferably a permanent magnet with a pulling force of at least 25 pounds. If an electromagnet is used, a battery of some kind must accompany the electromagnet in order to provide an electric current. In some embodiments, the magnet 40 is flat type or button type. The metal-containing load has metal components comprising metals such as iron, steel, brass, aluminum, etc. The magnet 40 may be positioned on either side of the block spacer 34. In an exemplary embodiment, the magnet 40 is positioned between the block spacer 34 and the load. The magnets 40 have variable height, width and length dimensions to allow them to fit within the pockets 30 and 32. In some embodiments, the block spacer itself is magnetized thus eliminating the need for a separate magnet included in the pocket with the block spacer. In this aspect of the invention, the block spacer functions as the magnet described above. In some embodiments, the magnet is embedded into the block spacer.

The block spacers 34 can be the same or different and can be formed from a wide variety of materials including metals (e.g., steel, aluminum, etc.), polymers (e.g., plastics), and ceramics. The block spacers 34 have height, width and length dimensions to allow them to fit within the pockets 30 and 32. The height of the block spacers 34 can vary (e.g., ½ to 1 inch, etc.) considerably and functions, together with the stitch line 28 to create a gap between the sleeve forming member 16 and the load in the configuration discussed below in connection with FIG. 3*a*. Preferably, the pockets 30 and 32 (or the entire interior surfaces of the sleeve forming member 16) are lined with an anti-abrasion material such as Kevlar® felt to help withstand ripping of the sleeve forming member at the edges of the block spacers 34.

Figure 3A:
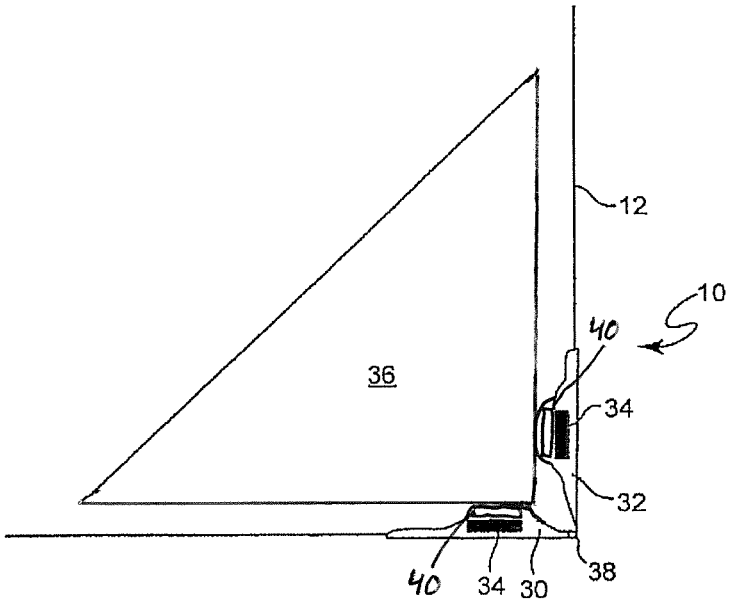
FIGS. 3*a-b* are alternative configurations of an exemplary heavy load protective pad in use with a sling in the presence of a load.

FIG. 3*a* shows one configuration for using the heavy load sling protective pad 10. In FIG. 3*a*, the block spacers 34 and magnets 40 in the pockets 30 and 32 are positioned between the load 36 and the sling 12. In this configuration, the block spacers 34 and stitch line 28 (shown in FIG. 2*b*) create a gap 38 at the corner or edge of the load 36. In this way, the corner edge of the load does not contact the sleeve forming member 16 or the underlying sling 12, even when the load is being lifted or pulled.

Figure 3B:
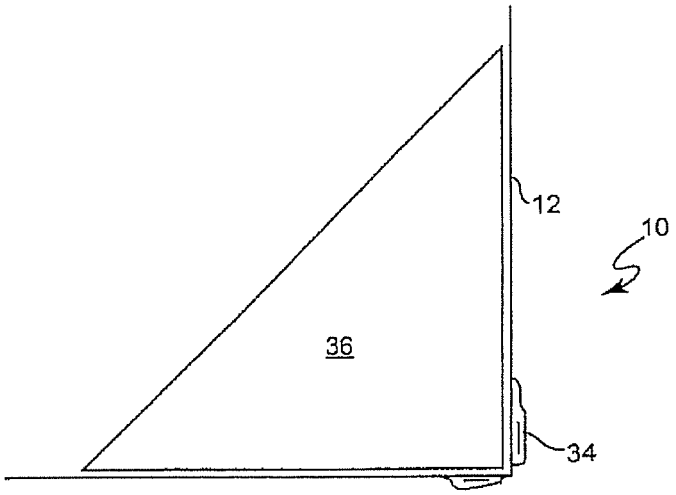

FIG. 3*b* shows an alternative configuration for using the heavy load sling protective pad 10 of the present invention. In FIG. 3*b*, the pad 10 is attached to the sling 12 such that the block spacers 34 are facing away from the load 36. In this configuration, protruding features of the load (not shown)

might be protected from damage when the load 36 is set on a surface due to the block spacers 34 spacing the load 36 from the surface.

Figure 4:
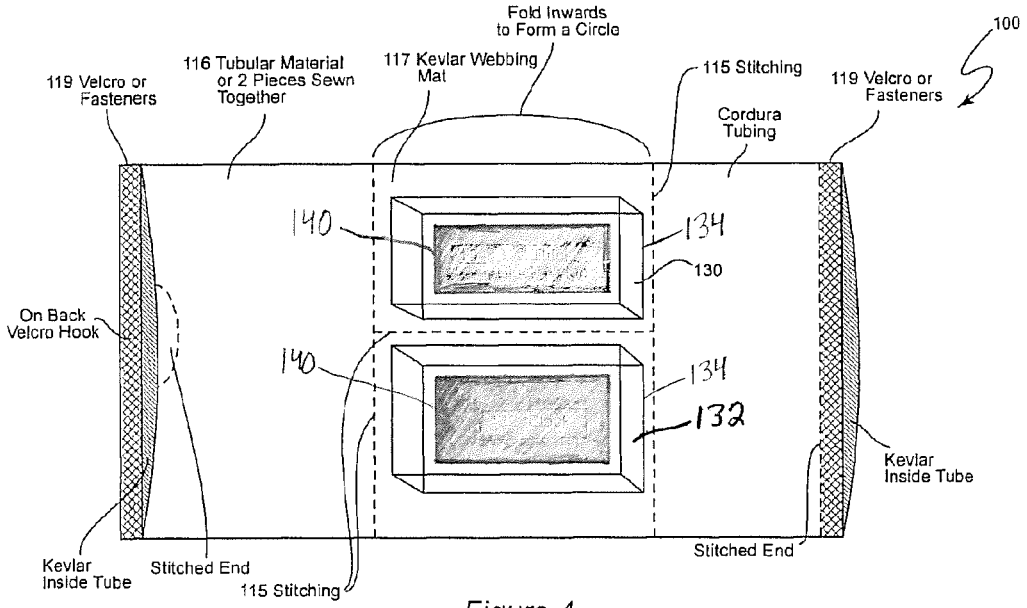
FIG. 4 is an alternative embodiment of the heavy load protective pad shown in FIGS. 1 and 2 *a-c.*

FIG. 4 is an alternative embodiment to the heavy load protective pad depicted in FIGS. 1 and 2*a-c* which is basically oriented sideways to the design shown in FIGS. 1 and 2*a-c*. Like that shown in FIG. 1, the heavy load protective pad 100 is composed of a sleeve forming member 116 made from a material that is tough, durable, etc., such as a Cordura® or Kevlar®, such that it can withstand abrasion, cuts, water damage, and ultraviolet damage, or any other adverse condition in which industrial slings will be used. In addition, the sleeve Ruining member 116 is preferably itself a sleeve of material (i.e., a tubular material such as that used to make hoses, etc.); however, in some applications the sleeve forming member 116 could be formed of two sheets of material that are joined together by stitching. As noted at the side edges stitching is indicated by the dashed lines (stitching would be used to close the ends of the hose type material).

In FIG. 4, unlike FIGS. 1 and 2*a-c*, the block spacers 134 (e.g., nylon or other polymer block, ceramics, steel plate, etc.) and magnets 140 are positioned in the top and bottom halves of the sleeve forming member 116 divided by a central stitch line. Stitching shown as dashed lines 115 are used to define the pockets 130 and 132 in which the block spacers 134 and magnets 140 are positioned. The pockets 130 and 132 can be lined with Kevlar felt or fabric 117. In FIG. 4, the pockets 130 and 132 are shown in the center of the sleeve forming member; however, the pockets 130 and 132 could be placed relatively closer either end of the sleeve forming member 116. Similar to the discussion above, the block spacers 134 and magnets 140 have height, width and length dimensions to allow them to fit within the pockets 130 and 132. The height of the block spacers 134 can vary (e.g., ½ to 1 inch, etc.) considerably. The block spacers 134 and magnets 140 function, together with the center stitch line (this time the center stitch line is along the axis of the sleeve forming member 116) to create a gap between the sleeve forming member 116 and the load in the configuration discussed above in connection with FIG. 3*a* (or to function in the alternative configuration shown in FIG. 3*b*).

In addition to the holding power of the magnet, fasteners may also be used. Velcro® (hook and loop) strips 119 are preferably sewn at either end of the underside of the sleeve forming member 116 (on the top, bottom or both top and bottom surfaces). For use, the sleeve forming member 116 is wrapped around the sling at any desired location and the ends are secured together using the fastening strips 119 (thereby forming a sleeve that encircles the sling). Other fasteners, e.g., hooks, snaps, buttons, etc., might also be employed to secure the protective pad 100 to the industrial sling. The embodiment of FIG. 4 can be used for lifting loads in either configuration respectively shown in FIGS. 3*a-b*.

While the invention has been described in teens of its preferred embodiments, those skilled in the art will recognize that the invention can be practiced with modification within the spirit and scope of the appended claims.

The invention claimed is:

1. A heavy load industrial sling protective pad, comprising:

only a single sleeve forming member;

fasteners on opposing first and second sides of said sleeve forming member wherein when said fasteners are joined, said sleeve forming member forms a sleeve which will encircle and secure the sleeve forming member to an industrial sling, first and second pockets defined by stitching in said sleeve forming member, said stitching including a first portion generally along a center line of said sleeve forming member between said first and second sides of said sleeve forming member, said stitching including a second portion generally perpendicular to said center line in at least one of said opposing first and second sides of said sleeve forming member, wherein said first and second portion of said stitching forms said first and second pockets in said at least one of said first and second sides of said sleeve forming member;

a block spacer positioned in each of said first and second pockets, each of said block spacers having height, length and width dimensions wherein said height dimension is sufficient to space an edge or a corner of a load away from said industrial sling by forming a gap between said block spacers in said first and second pockets and said second portion of said stitching when said sleeve forming member is positioned on said industrial sling in a first configuration with said block spacers facing said load; and a magnet positioned in at least one of said first and second pockets.

2. The heavy load industrial sling protective pad of claim 1, wherein said sleeve forming member is only a single sleeve forming member.

3. The heavy load industrial sling protective pad of claim 1, wherein said magnet is positioned in each of said first and second pockets.

4. The heavy load industrial sling protective pad of claim 1, wherein said magnet is embedded in said block spacer.

5. The heavy load industrial sling protective pad of claim 1, wherein when said fasteners are joined to form said sleeve said first portion will be on a side of said sleeve opposite said fasteners.

6. The heavy load industrial sling protective pad of claim 5, wherein said fasteners are hook and loop fasteners.

7. The heavy load industrial sling protective pad of claim 6, wherein said fasteners are hook and loop fasteners in a form of two strips, a first and second strip.

8. The heavy load industrial sling protective pad of claim 5, wherein said fasteners are in two groups or strips, wherein a first of said two groups or strips spans a first edge of said sleeve forming member at said first side and a second of said two groups or strips span a second edge of said sleeve forming member at said second side, wherein said sleeve is formed when said first and second groups of fasteners are joined.

9. The heavy load industrial sling protective pad of claim 5, wherein said center line is between said first and second sides of said sleeve forming member, and wherein said second portion of said stitching is in one of said first and second sides of said sleeve forming member.

10. The heavy load industrial sling protective pad of claim 1, wherein at least one of said block spacers is made of a plastic material.

11. The heavy load industrial sling protective pad of claim 1, wherein at least one of said block spacers is made of a metal material.

12. The heavy load industrial sling protective pad of claim 1, wherein at least one of said block spacers is made of a ceramic material.

13. The heavy load industrial sling protective pad of claim 1, wherein said sleeve forming member is constructed so as to be capable of assuming a second configuration with said block spacers facing away from said load.

14. The heavy load industrial sling protective pad of claim 1, wherein said pockets are lined with an abrasion resistant material.

15. The heavy load industrial sling protective pad of claim 1, wherein said magnet is attached to said block spacer.

16. The heavy load industrial sling protective pad of claim 1, wherein said magnet is flat type or button type.

17. A heavy load industrial sling protective pad, comprising:

a sleeve forming member;

fasteners on opposing first and second sides of said sleeve forming member wherein when said fasteners are joined, said sleeve forming member forms a sleeve which will encircle and secure the sleeve forming member to an industrial sling and wherein when said fasteners are joined to form said sleeve said first portion will be on a side of said sleeve opposite said fasteners, and wherein said fasteners are hook and loop fasteners in a form of two strips, a first and second strip, first and second pockets defined by stitching in said sleeve forming member, said stitching including a first portion generally along a center line of said sleeve forming member between said first and second sides of said sleeve forming member, said stitching including a second portion generally perpendicular to said center line in at least one of said opposing first and second sides of said sleeve forming member, wherein said first and second portion of said stitching forms said first and second pockets in said at least one of said first and second sides of said sleeve forming member;

a block spacer positioned in each of said first and second pockets, each of said block spacers having height, length and width dimensions wherein said height dimension is sufficient to space an edge or a corner of a load away from said industrial sling by forming a gap between said block spacers in said first and second pockets and said second portion of said stitching when said sleeve forming member is positioned on said industrial sling in a first configuration with said block spacers facing said load; and a magnet positioned in at least one of said first and second pockets, wherein said sleeve forming member has a top and a bottom surface, and wherein said first strip of said hook and loop fasteners spans an entire length of said first edge of said sleeve forming member and is positioned on said top surface of said sleeve forming member, and wherein said second strip of said hook and loop fasteners spans an entire length of said second edge of said sleeve forming member and is positioned on said top surface of said sleeve forming member.

18. A heavy load industrial sling protective pad, comprising:

only a single sleeve forming member;

fasteners on opposing first and second sides of said sleeve forming member wherein when said fasteners are joined, said sleeve forming member forms a sleeve which will encircle and secure the sleeve forming member to an industrial sling, first and second pockets defined by stitching in said sleeve forming member, said stitching including a first portion generally along a center line of said sleeve forming member between said first and second sides of said sleeve forming member said stitching including a second portion generally perpendicular to said center line in at least one of said opposing first and second sides of said sleeve forming member, wherein said first and second portion of said stitching forms said first and second pockets in said at least one of said first and second sides of said sleeve forming member; and a block spacer positioned in each of said first and second pockets, each of said block spacers having height, length and width dimensions wherein said height dimension is sufficient to space an edge or a corner of a load away from said industrial sling by forming a gap between said block spacers in said first and second pockets and said second portion of said stitching when said sleeve forming member is positioned on said industrial sling in a first configuration with said block spacers facing said load, wherein said block spacer is magnetized.

19. The heavy load industrial sling protective pad of claim 18, further comprising fasteners on opposing first and second sides of said sleeve forming member wherein when said fasteners are joined, said sleeve forming member forms a sleeve which will encircle and secure the sleeve forming member to an industrial sling and wherein when said fasteners are joined to form said sleeve said first portion will be on a side of said sleeve opposite said fasteners.

* * * * *